US006790518B2

(12) United States Patent
Grace et al.

(10) Patent No.: US 6,790,518 B2
(45) Date of Patent: Sep. 14, 2004

(54) DUCTILE HYBRID STRUCTURAL FABRIC

(75) Inventors: Nabil F. Grace, Rochester Hills, MI (US); Wael F. Ragheb, Windsor (CA); George Abdel-Sayed, Bloomfield Hills, MI (US)

(73) Assignee: Lawrence Technological University, Southfield, MI (US)

( * ) Notice: Subject to any disclaimer, the term of this patent is extended or adjusted under 35 U.S.C. 154(b) by 0 days.

(21) Appl. No.: 10/164,737

(22) Filed: Jun. 7, 2002

(65) Prior Publication Data

US 2003/0110733 A1 Jun. 19, 2003

Related U.S. Application Data

(60) Provisional application No. 60/342,026, filed on Dec. 19, 2001, and provisional application No. 60/342,027, filed on Dec. 19, 2001.

(51) Int. Cl.[7] ..... B32B 13/02

(52) U.S. Cl. ..... 428/298.1; 428/294.7; 442/204; 52/414

(58) Field of Search ..... 428/298.1, 294.7; 442/204; 52/414

(56) References Cited

U.S. PATENT DOCUMENTS

| | | | |
|---|---|---|---|
| 3,446,251 | A | 5/1969 | Dow |
| 3,644,165 | A | 2/1972 | Chen |
| 3,813,098 | A | 5/1974 | Fischer et al. |
| 4,020,209 | A | 4/1977 | Yuan |
| 4,438,173 | A | 3/1984 | Trost |
| 4,581,275 | A | 4/1986 | Endo et al. |
| 4,617,219 | A | 10/1986 | Schupack |
| 4,668,325 | A | 5/1987 | Katz |
| 4,786,341 | A | 11/1988 | Kobatake et al. |
| 5,106,678 | A | 4/1992 | Abu-Isa |
| 5,151,146 | A | 9/1992 | Green |
| 5,218,810 | A | 6/1993 | Isley, Jr. |
| 5,245,813 | A | 9/1993 | Brotz |
| 5,318,832 | A | 6/1994 | Fishel et al. |
| 5,326,410 | A | 7/1994 | Boyles |
| 5,447,593 | A | 9/1995 | Tanaka et al. |
| 5,451,465 | A | 9/1995 | Garrioch |
| 5,481,838 | A | 1/1996 | Fishel et al. |
| 5,505,030 | A | 4/1996 | Michalcewiz et al. |
| 5,525,413 | A | 6/1996 | Daurer et al. |
| 5,538,781 | A | 7/1996 | Rao et al. |

(List continued on next page.)

OTHER PUBLICATIONS

Philip A. Ritchie et al., "External Reinforcement Of Concrete Beams Using Fiber Reinforced Plastics," ACI Structural Journal, Title No. 88–S52, Jul.–Aug. 1991; pp. 490–500.

(List continued on next page.)

*Primary Examiner*—Elizabeth M. Cole
(74) *Attorney, Agent, or Firm*—Dickinson Wright PLLC

(57) ABSTRACT

A structural fabric having a first fiber with a first ultimate strain and a second fiber with a second ultimate strain greater than the first ultimate strain, the first and second fibers being in the same plane. The invention is further directed to a structural fabric having a plurality of axial fibers and a plurality of first diagonal fibers braided with the axial fibers and oriented at a first braid angle relative thereto. The axial fibers include first and second fibers each with an ultimate strain. The ultimate strain of the second fiber again being greater than the ultimate strain of the first fiber. Additionally, the invention is directed to a concrete beam strengthened with the structural fibers of the present invention.

31 Claims, 16 Drawing Sheets

U.S. PATENT DOCUMENTS

| | | | |
|---|---|---|---|
| 5,540,870 | A | 7/1996 | Quigley |
| 5,591,291 | A | 1/1997 | Blackmore |
| 5,595,625 | A | 1/1997 | Fishel et al. |
| 5,599,599 | A | 2/1997 | Mirmiran et al. |
| 5,607,527 | A | 3/1997 | Isley, Jr. |
| 5,633,057 | A | 5/1997 | Fawley |
| 5,648,137 | A | 7/1997 | Blackmore |
| 5,649,398 | A | 7/1997 | Isley, Jr. et al. |
| 5,657,595 | A | 8/1997 | Fyfe et al. |
| 5,677,046 | A | 10/1997 | Fawley et al. |
| 5,702,993 | A | 12/1997 | Kubomura et al. |
| 5,727,357 | A | 3/1998 | Arumugasaamy et al. |
| 5,763,043 | A | 6/1998 | Porter et al. |
| 5,768,847 | A | 6/1998 | Policelli |
| 5,846,364 | A | 12/1998 | Policelli |
| 5,924,262 | A | 7/1999 | Fawley |
| 6,123,485 | A | 9/2000 | Mirmiran et al. |
| 6,127,293 | A | 10/2000 | Kimura et al. |
| 6,183,835 | B1 | 2/2001 | Cho et al. |
| 6,189,286 | B1 | 2/2001 | Seible et al. |
| 6,238,761 | B1 | 5/2001 | Jeong et al. |

OTHER PUBLICATIONS

T.C. Triantafillou et al., "Strengthening Of RC Beams With Epoxy–Bonded Fibre–Composite Materials," Materials and Structures, 25:201–211, 1992.

Michael J. Chajes et al., "Shear Strengthening Of Reinforced Concrete Beams Using Externally Applied Composite Fibers," ACI Structural Journal, Title No. 92–S28, May–Jun. 1995, pp. 295–303.

John G.S. Alexander et al., "Shear Strengthening Of Small Scale Concrete Beams With Carbon Fibre Reinforced Plastic Sheets," 1996 CSCE Conference Paper, 10 pages.

Y. Sato et al., "Shear Reinforcing Effect Of Carbon Fiber Sheet Attached To Side Of Reinforced Concrete Beams ," Advanced Composite Materials In Bridges And Structures, 1996, pp. 621–628.

Tom Norris et al., "Shear And Flexural Strengthening Of R/C Beams With Carbon Fiber Sheets," Journal Of Structural Engineering, Jul. 1997, pp. 903–911.

Marco Arduini et al., "Brittle Failure In FRP Plate And Sheet Bonded Beams," ACI Structural Journal, Title No. 94–S33, Jul.–Aug. 1997, pp. 363–370.

Luc Taerwe et al.,"Behaviour Of RC Beams Strengthened In Shear By External CFRP Sheets," Non–Metallic (FRP) Reinforcement Of Concrete Structures, Proceedings Of The Third International Symposium, vol. 1, Oct. 1997, pp. 483–490.

Kenji Umezu, "Shear Behavior Of RC Beams With Aramid Fiber Sheet," Non–Metallic (FRP) Reinforcement Of Concrete Structures, Proceedings Of The Third International Symposium, vol. 1, Oct. 1997, pp. 491–498.

Thanasis C. Triantafillou, "Shear Strengthening Of Reinforced Concrete Beams Using Epoxy–Bonded FRP Composites," ACI Structural Journal, Title No. 9–S11, Mar.–Apr. 1998, pp. 107–115.

O. Chaallal et al., "Shear Strengthening Of RC Beams By Externally Bonded Side CFRP Strips," Journal Of Composites For Construction, May 1998, pp. 111–113.

Ahmed Khalifa et al., "Contribution Of Externally Bonded FRP To Shear Capacity Of RC Flexural Members," Journal Of Composites For Construction, Nov. 1998, pp. 195–202.

N.F. Grace et al., "Strengthening Reinforced Concrete Beams Using Fiber Reinforced Polymer (FRP) Laminates," ACI Structural Journal, Title No. 96–S95, Sep.–Oct. 1999, pp. 865–874.

Francesco Bencardino et al., "Strength And Ductility Of Reinforced Concrete Beams Externally With Carbon Fiber Fabric," ACI Structural Journal, Title No. 99–S18, Mar.–Apr. 2002, pp. 163–171.

Hamid Saadatmanesh et al., "RC Beams Strengthened With GFRP Plates. I: Experimental Study," Journal Of Structural Engineering, vol. 117, Nov. 1991, pp. 3417–3433.

FIG - 1
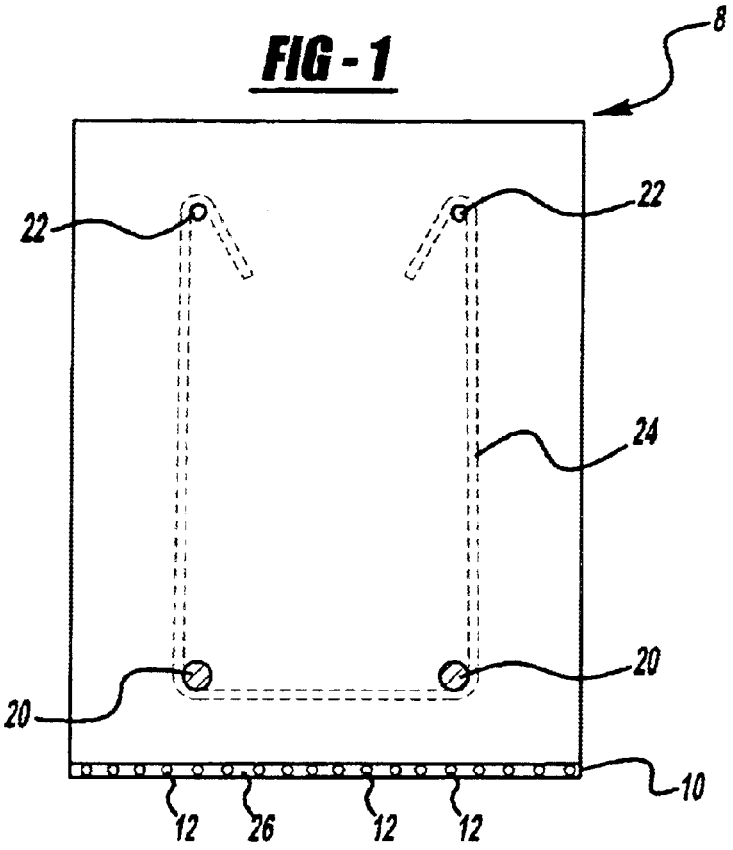
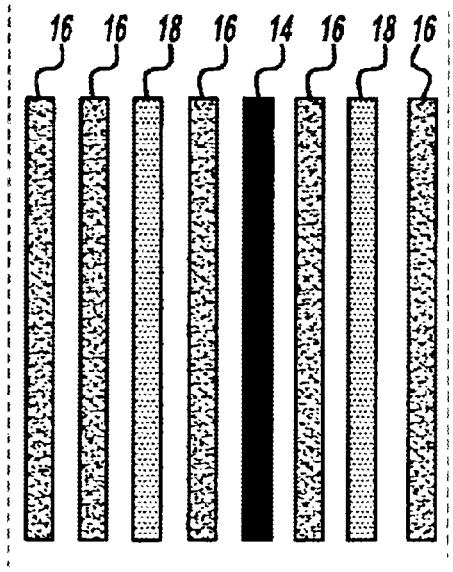
FIG - 3

DUCTILE HYBRID STRUCTURAL FABRIC

CROSS-REFERENCES TO RELATED APPLICATIONS

This application claims the benefit of U.S. Provisional Application No. 60/342,026, filed Dec. 19, 2001, and U.S. Provisional Application No. 60/342,027, filed Dec. 19, 2001, the entire disclosure of these applications being considered part of the disclosure of this application and hereby incorporated by reference.

SPONSORSHIP

This invention was made with Government support under Grant No. CMS-9906404 awarded by the National Science Foundation. The Government has certain rights in this invention.

BACKGROUND OF THE INVENTION

High strength composite fibers have been used for a variety of applications. For example, the use of externally bonded fiber reinforced polymer (FRP) sheets, strips, and fabrics have been recently established as an effective tool for rehabilitating and strengthening steel-reinforced concrete structures. Steel-reinforced concrete beams strengthened with FRP strengthening systems show higher ultimate load strengths compared to non-strengthened concrete beams. However, available FRP strengthening systems suffer from a variety of disadvantages and drawbacks including lack of ductility and high orthotropic characteristics.

Loss of beam ductility is partially attributable to the brittle nature of fibers used in FRP strengthening systems. Fibers commonly used in FRP strengthening systems, such as carbon fibers, glass fibers, or aramid fibers while exhibiting higher ultimate tensile strengths than steel reinforcement, tend to fail catastrophically and without visual warning. Visual indicators of structural weaknesses are desirable as they permit the opportunity for remedial actions prior to failure. Accordingly, it would be desirable to realize the strengthening benefits of FRP systems without sacrificing beam ductility.

As to the timing of the load gains from FRP strengthening, it is noted that FRP strengthening materials behave differently from steel. Although fibers used in FRP materials have high strengths, they generally stretch to relatively high strain values before providing their full strength. Steel also has a relatively low yield strain value (on the order of 0.2% for Grade 60 steel) compared to the yield strain of commonly used FRP fibers (on the order of 1.4–1.7% for Carbon fibers and 2–3% for glass fibers). Accordingly, the degrees of contribution of the reinforcing steel and the strengthening FRP materials differ with the magnitude that the strengthened element deforms, with FRP contributions being most significant after the yield strain of steel. Stated differently, the steel reinforcement commonly yields before the FRP provides any significant strengthening. As the working or design load of a structural component is principally based upon its yield strength, the fact that currently available FRP strengthening systems contribute a majority of the gained increase in load capacity after, rather than before or simultaneously with, the yielding of the steel reinforcement limits the usefulness of FRP strengthening systems.

In attempting to provide reasonable contribution from FRP material during limited deformations, some designers have increased the cross-sectional area of the FRP sheets. However, this approach is not economical. Moreover, the added cross-sectional area makes debonding of the FRP strengthening material from the surface of the concrete/steel beam more likely due to higher stress concentrations, thereby increasing the probability of undesirable brittle failures. Other approaches to more fully capitalizing on the strength of FRP fabrics have focused on the use of special low strain fibers, such as ultra high modulus carbon fibers. While this approach does improve the contribution of the FRP strengthening prior to yielding of the steel reinforcement, the fibers still contribute to brittle failures.

Additionally, currently available FRP fabrics, sheets, and strips also have high orthotropic characteristics. That is, the fabrics provide strengthening only in the direction of fiber orientation. The orthotropic characteristic of FRP fabrics limit their usefulness in applications subjected to multi-directional loads such as simultaneous flexure and shear strengthening of structural components.

In view of these deficiencies in the art, there is a need for a ductile structural fabric, such as an FRP fabric or sheet. In certain applications, such as the strengthening of steel-reinforced concrete beams or structural components, the fabric also preferably exhibits a low strain yield so that the fabric effectively enhances the strength of the beam prior to yielding of the steel reinforcement. Additionally, there is also a desire to provide a ductile structural fabric which can be used for strengthening in more than one direction. In other words, the fabric is desired to have reduced orthotropic characteristics.

SUMMARY OF THE INVENTION

The present invention is directed to a structural fabric having a first fiber with a first ultimate strain, a second fiber with a second ultimate strain greater than the first ultimate strain, the first and second fibers being in the same plane. The invention is further directed to a structural fabric having a plurality of axial fibers and a plurality of first diagonal fibers braided with the axial fibers and oriented at a first braid angle relative thereto. The axial fibers include first and second fibers each with an ultimate strain. The ultimate strain of the second fiber again being greater than the ultimate strain of the first fiber. Additionally, the invention is directed to a concrete beam strengthened with the structural fibers of the present invention.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

FIG. 1 is a cross-sectional view of a reinforced concrete beam with an FRP fabric in accordance with the present invention;

FIG. 3 is a plan view of the repeating cell of fibers in the fabric of FIG. 2 illustrating the mix of axial fibers within the fabric;

DETAILED DESCRIPTION OF THE PREFERRED EMBODIMENT

The present invention will now be described with reference to the attached figures. The invention is generally directed to a Ductile Hybrid Fabric (DHF), such as an FRP fabric, having a plurality of fibers oriented in a predetermined repeating pattern. The first described embodiment of the invention relates to a uniaxial fabric wherein the fibers are positioned in a single plane and oriented parallel to one another. The second embodiment is a triaxial fiber having axial fibers and diagonal fibers in two directions. In each embodiment, the fabric includes at least two fibers having different elongation characteristics embedded in a matrix. The type, size, proportion, and location of the individual fibers are selected to provide a high strength and ductile structural fabric specifically tailored to a particular application. When used to strengthen steel-reinforced concrete elements, such as beams, the fabric composition is specifically selected to contribute to the strength of the reinforced structural component before, during, and after yielding of the steel reinforcing material.

While this description and the appended figures illustrate the general configuration and performance of a DHF in the form of a uniaxial FRP fabric and a triaxial FRP fabric, those skilled in the art will appreciate that modifications to the fabric configurations described herein may be made to tailor the fabric to a particular application without departing from the scope of the invention as defined by the appended claims.

Further, while the following description relates specifically to use of the fabrics to reinforce structural concrete beams, the principles and benefits of the invention are useful in a variety of other structural reinforcing applications as well as other environments wherein the high strength and ductile behavior of the fabric is desirable. For example, the fabric can be used as an energy absorbing structural component of a building or vehicle that increases the ability of the structure or vehicle to dissipate energy including impact energy resulting from terrorist weaponry. The fabric can be used with a variety of injected matrices to increase the strength of buildings subject to attack, such as nuclear power plants, high-rise buildings, highway/railroad bridges, and the like. The DHF can be formed in solid shapes and configurations to develop structural panels, structural components or reinforcement for vehicles and aircraft fuselages as well as critical components of military vehicles such as tracks, wheels, panels, drive shafts, and suspension systems thereby reducing the weight of such vehicles and permitting more efficient transportation, better fuel economy, and improved maneuverability. The fabric can also be used as a structural component for sports goods.

Figure 2:
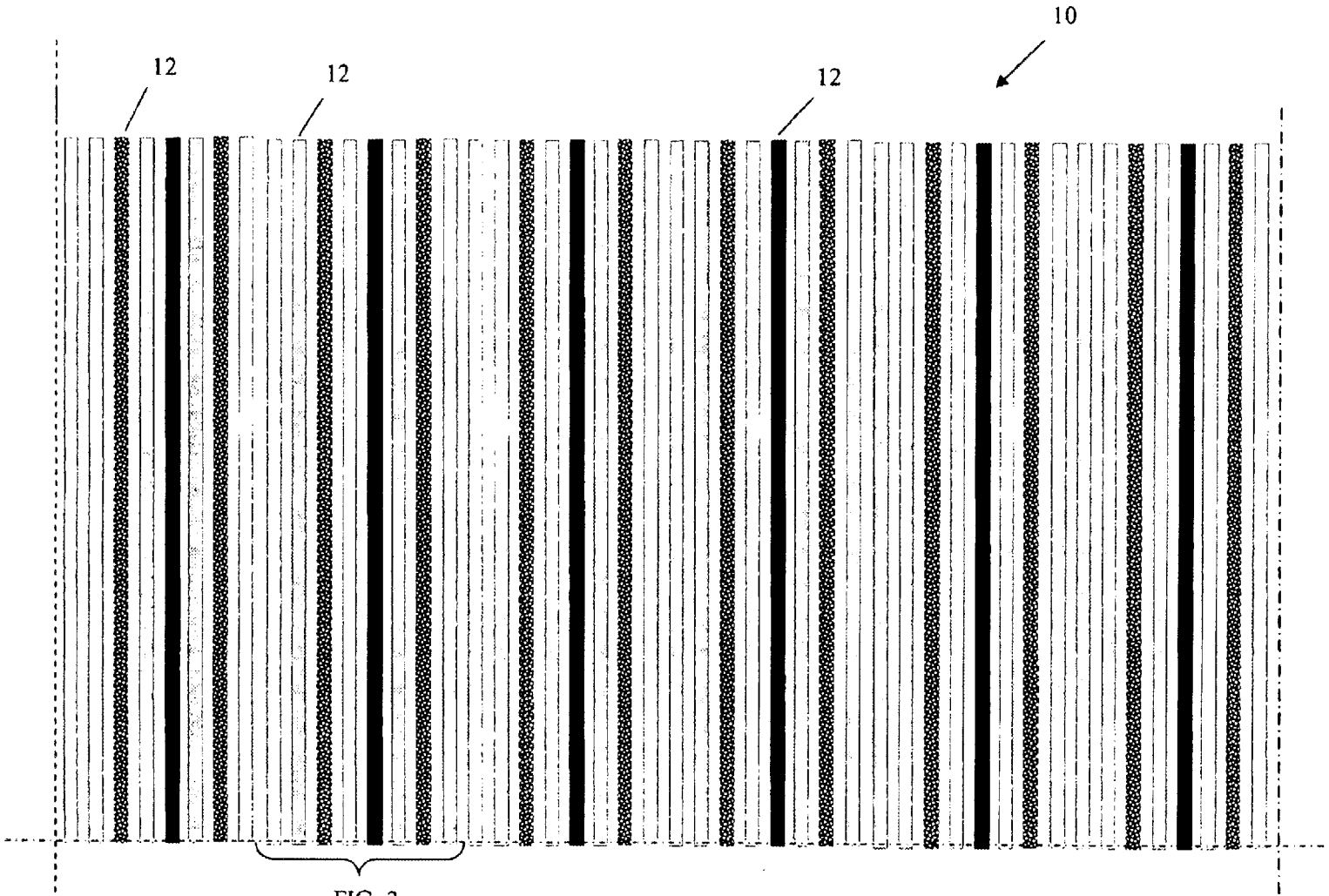
FIG. 2 is a plan view of a fabric having a plurality of axial yarns in accordance with the present invention.

FIG. 1 is a cross-sectional view of a representative concrete beam 8 having a structural fabric 10 according to the present invention adhered to the bottom surface of the beam. A representative embodiment of the uniaxial fabric 10, which is further illustrated and described herein with reference to FIGS. 2 and 3, is specifically designed to structurally reinforce a variety of structures, such as the illustrated steel reinforced concrete beam 8. The fabric 10 improves beam strength and stiffness while exhibiting ductile characteristics that provide significant energy dissipation during loading.

With specific references to FIGS. 2 and 3, the fabric 10 is shown to have a plurality of axial yarns or fibers 12 that include at least two axial fibers 14 and 16 having different elongation characteristics. As used herein, a fiber's elongation characteristic refers to the strain that the fiber withstands prior to yield or ultimate failure. Various fibers are referred to herein as "low elongation," "medium elongation" and "high elongation." These terms refer to the elongation characteristics of fibers relative to one another. Thus, low elongation fibers withstand relatively small amounts of strain prior to yielding or failure and high elongation fibers withstand greater deformation. As will be further described below, the selection of fibers having the desired elongation characteristics may be further based upon the deformation behavior of the materials of the reinforced structure (e.g., the concrete beam), the desired load transitioning between fibers 12, as well as the ultimate strength of the fabric reinforced beam.

In the fabric 10, the fibers are impregnated in a matrix 26, such as an epoxy resin, that bonds the fibers to one another and to the beam in a manner that ensures that all fibers elongate at the same rate. The matrix is injected or interspersed throughout the fabric to fill the voids between the fibers as well as to provide a uniform outer surface and an appropriate bonding surface for coupling the fabric to the beam or other material to be strengthened. The matrix material is preferably selected so that its ultimate strain is greater than the ultimate strain of the highest elongation fibers in the fabric. Based upon testing performed to date, it is anticipated that an epoxy such as DER 332 resin and DEH 24 hardener (produced by The Dow Chemical Company) is suitable. The epoxy should be chemically and thermally compatible with the selected fibers. Notwithstanding the suitability of the identified epoxy, it should be appreciated that other matrix materials may be used. For example, a high-strength cement slurry may be particularly suitable for certain applications, including fabrics used to reinforce outer surfaces of a building to increase the building's impact resistance. The matrix preferably provides further benefits of thermal resistance and preventing spalling of strengthened concrete structural components. Those skilled in the art will appreciate that a variety of other polymeric and non-polymer matrix materials may be used without departing from the scope of the invention defined by the appended claims.

FIG. 3 is a plan view of a portion of the uniaxial fabric 10 of FIG. 2 illustrating a repeating cell of axial fibers 14 and 16 within the uniaxial fabric 10. As noted above, the desirable strength and ductility characteristics of the fabric and reinforced beam are achieved by incorporating at least two fibers having different elongation characteristics into the fabric. More particularly, the fabric includes one axial fiber 14 having low elongation characteristics and another axial fiber 16 having high elongation characteristics. The type, size, proportion, and location of the fibers 14 and 16 are selected to provide a desired stress-strain response as the uniaxial fabric 10 is loaded in tension. More particularly, when the uniaxial fabric 10 is loaded in tension, the low elongation fibers 14 fail before the high elongation fibers 16 allowing a strain relaxation or, in other words, an increase in strain without an increase in load. The resulting ductile behavior of the fabric assists in energy dissipation and further provides visual or other indicators of dimensional instability. For example, the fabric commonly generates an audible "clicking" as the fibers fail.

The remaining high elongation fibers 16 are proportioned to sustain the total load up to failure. The ultimate strain of the low elongation fibers 14 presents the value of the yield strain of the uniaxial fabric 10 while the ultimate strain of the high elongation fibers 16 presents the value of ultimate fabric strain. Similarly, the load corresponding to the failure of the low elongation fibers 14 presents the yield load value of the fabric and the maximum load carried by the high elongation fibers 16 is the ultimate load value.

When using the fabric 10 of the present invention to strengthen steel reinforced concrete beams, it is preferred that the low elongation fibers exhibit an ultimate strain equal to or slightly greater than the yield strain of the reinforcing steel (e.g., about 0.2% for Grade 60 steel). Accordingly, the low elongation fibers contribute significantly to the yield strength of the fabric reinforced beam. Ultra high modulus carbon fibers with a failure strain of approximately 0.35% (e.g, Carbon #1) have been found to be suitable low elongation fibers for such applications. As to the high elongation fibers 16, it is preferred that these fibers exhibit a significantly higher ultimate strain to produce a high ductility index (the ratio between deformation at failure and deformation at first yield). E-glass fibers, such as those available from PPG industries (Hybon 2022) and having 2.1% ultimate strain have been found to be suitable for such applications. After the fabric reinforced beam exceeds its yield strain, e.g., after the low elongation fibers fail, the high elongation fibers 16 sustain the load up to the failure of the beam.

In the embodiment of the present invention illustrated in FIGS. 2 and 3, the plurality of axial yarns 12 even more preferably include three axial fibers 14, 16, and 18 each having different elongation characteristics. The three axial fibers include the above-described low elongation fibers 14 and high elongation fibers 16 as well as medium elongation fibers 18. Preferably, the medium elongation fibers 18 are high modulus carbon fibers having a failure strain of about 0.8% to about 1.0% (such as Carbon #2 or Carbon #3). The medium elongation fibers 18 minimize the load drop during the strain relaxation occurring after failure of the low elongation fibers 14 thereby gradually transitioning the load from the low elongation fibers 14 to the high elongation fibers 16 and enhancing the energy dissipation and ductility of the fabric. Those skilled in the art will appreciate that additional axial fibers having different elongation characteristics may be included in the fabric to further graduate the transition of load between successively breaking fibers.

As noted above, the specific type, size, proportion, and location of fibers used within the fabric 10 of the present invention may vary based upon the desired performance and fabric application. Moreover, a triaxial fabric 40 is described below to include a fiber arrangement in three directions and comprised of fibers whose type, size, proportion, and location are similarly selected based upon performance criteria. While a variety of factors may impact the suitability of a particular fiber material, factors of particular concern include the modulus of elasticity and failure strain of each fiber. These performance characteristics impact the overall ductility and energy dissipation characteristics of the fabric. Table 1 illustrates the preferred fiber material for the uniaxial and triaxial fabric described herein with the Carbon #2 medium elongation fibers being used in the three fiber uniaxial fabric and the Carbon #3 medium elongation fibers being used in the triaxial fabric. The modulus of elasticity and tensile strength values shown in Table 1 are composite properties based upon a 60% fiber volume fraction.

TABLE 1

Mechanical properties of the materials

| Type | Material | Description | Modulus Of Elasticity GPa (Msi) | Tensile Strength Mpa (ksi) | Failure Strain (%) |
|---|---|---|---|---|---|
| Low Elongation | Carbon #1 | Ultra-High Modulus Carbon Fibers | 379 (55) | 1324 (192) | 0.35 |
| Medium Elongation | Carbon #2 | High Modulus Carbon Fibers | 231 (33.5) | 2413 (350) | 0.9–1.0 |
| Medium Elongation | Carbon #3 | High Modulus Carbon Fibers | 265 (38.5) | 2200 (320) | 0.8 |
| High Elongation | Glass | E-Glass Fibers | 48 (7) | 1034 (150) | 2.1 |

Figure 16:
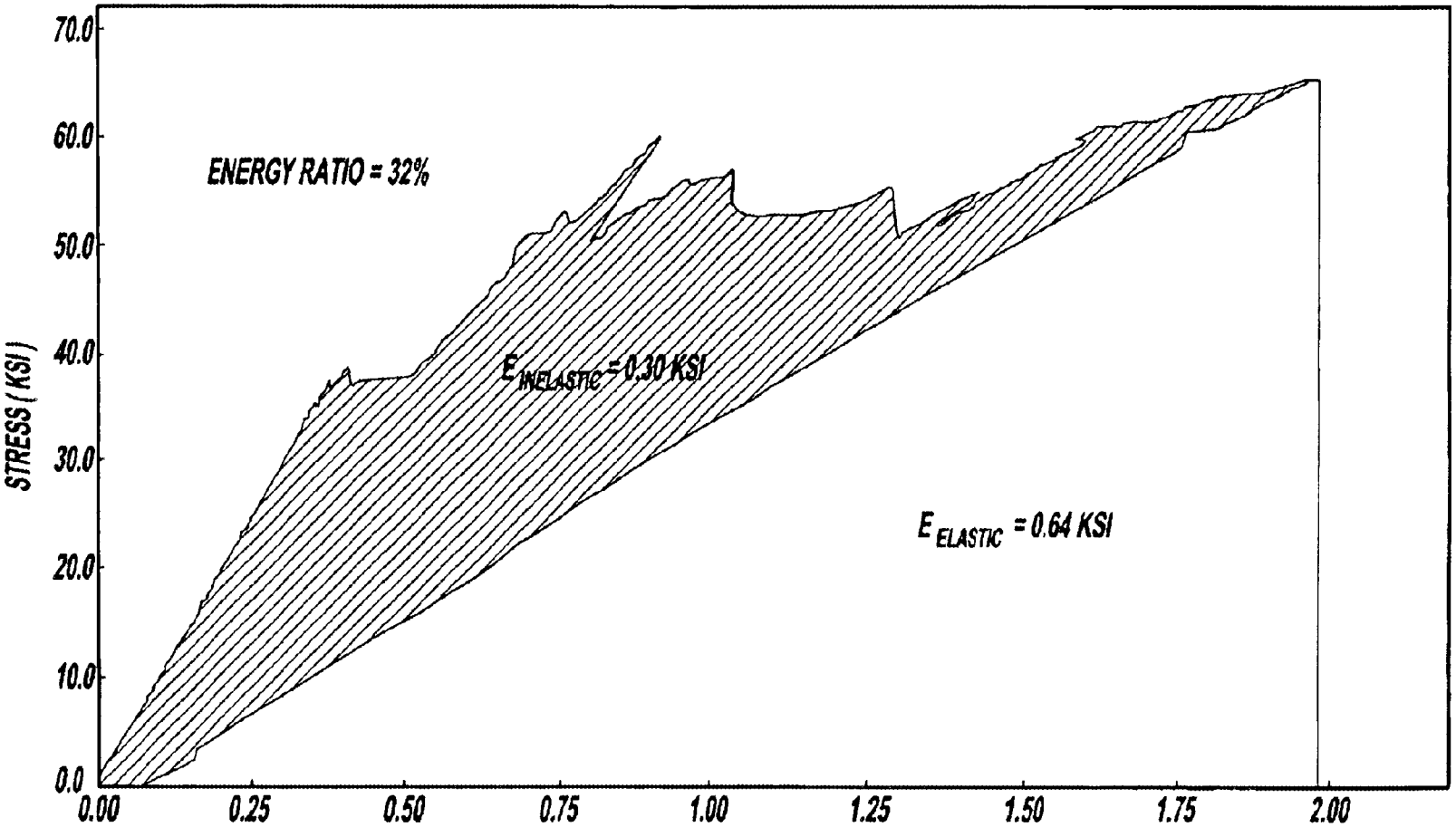
FIG. 16 is a graph illustrating the stress-strain behavior of the uniaxial fabric and showing the energy absorption.
Figure 17:
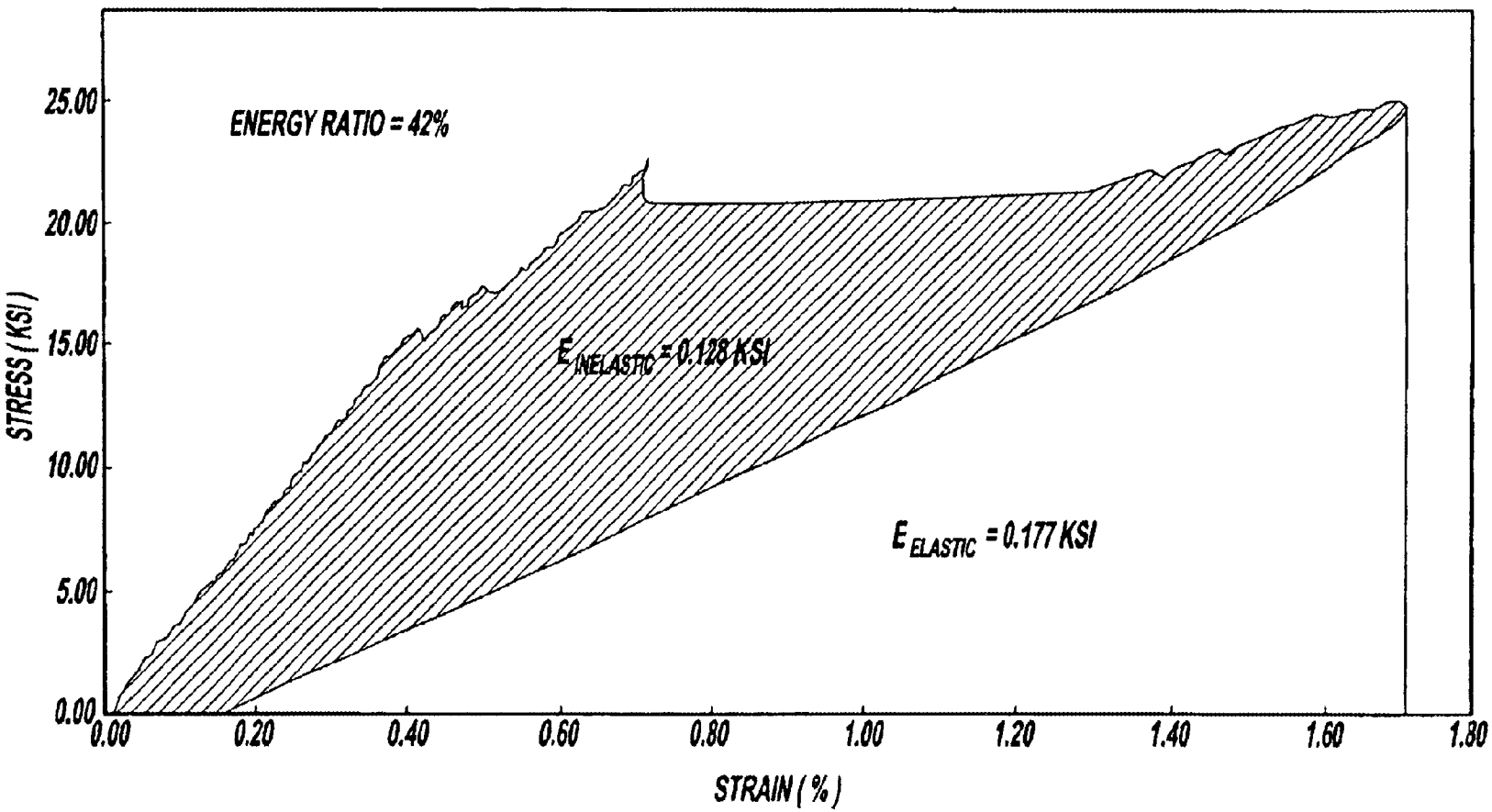
FIG. 17 is a graph illustrating the axial stress-strain behavior of the triaxial fabric and showing the energy absorption.

The specific fiber materials identified in Table 1 were selected to maximize the energy absorption ratio of the fabric while also considering the other design factors discussed herein, particularly cost and manufacturability. In making the selection, different fabric compositions and arrangements were modeled through the use of a textile composite fabric modeling software developed by National Aeronautics and Space Administration (NASA) and referred to as TEXCAD. Examples of the energy absorption capabilities of the uniaxial fabric 10 and the triaxial fabric 40, respectively, are shown in FIGS. 16 and 17 which illustrate representative stress/strain behavior of test samples that were unloaded just before failure. The shaded areas in FIGS. 16 and 17 illustrate the absorbed energies after unloading of the samples. The magnitude of the absorbed energy is dictated by the inelastic deformation of the fabric characterized by the strain relaxation occurring when fibers fail. The uniaxial fabric exhibited an energy absorption ratio (the ratio between the absorbed energy to the total energy) of approximately 32% before failure, while the triaxial fabric exhibited an energy absorption ratio of approximately 42%.

While representative low, medium, and high elongation fibers are generally described above, it should be appreciated that the type, size, proportion, and location of the fibers should be considered in formulating the specific configuration of the fabric 10. As to the types of fibers, while ultra-high modulus carbon fibers, high modulus carbon fibers, and E-glass fibers are generally suitable for the low, medium, and high elongation fibers, respectively, the selection of the particular fibers for an application should consider tensile strength, elongation, modulus of elasticity, creep rupture, and shear strength as well as cost and manufacturability. As is discussed above, despite the number of factors that may impact the fiber selection, the factors of particular interest generally are the failure strain and modulus of elasticity of the respective fibers and the impact of these factors on the ductility and energy dissipation capabilities of the fabric. Based upon this description, those skilled in the art will be able to select suitable fibers from those commonly available in the art including ultra high modulus carbon fibers, high modulus carbon fibers, regular modulus carbon fibers, S-glass fibers, aramid fibers, and nylon fibers.

As to the relative proportion and location of the fibers within the fabrics, fibers having different elongation characteristics are preferably distributed along the fabric to provide a generally uniform distribution of the different fiber types. The number of each type of fiber should be selected to ensure that the respective fibers fail at the desired loadings. By way of example, the repeating cell of the fabric 10 illustrated in FIGS. 2 and 3 include eight individual fibers. The fibers are positioned, from left to right, with a single low elongation fiber at position 5, medium elongation fibers at positions 3 and 7, and high elongation fibers at positions 1, 2, 4, 6, and 8. The low elongation fibers 14 are made from ultra high modulus carbon fibers, the medium elongation fibers 18 from high modulus carbon fibers, and the high elongation fibers 16 are made from E-glass fibers. The spacing between fibers 14, 16, and 18 is approximately 0.125 inches. This configuration was developed using the above described preferred fiber materials in order to strengthen a steel reinforced concrete beam as described in the following test results. The testing of the fabric reinforced concrete beams indicate improved yield strengths, ultimate strengths, and ductile behavior not previously achieved with FRP strengthening systems.

It should be appreciated that the specific fabric configuration as well as the test results are provided for illustration and should not be interpreted to unduly limit the scope of the present invention. The uniaxial fabric 10 having low, medium, and high elongation fibers shown in FIGS. 2 and 3 was tested on reinforced concrete beams 8 (FIG. 1) having cross sectional dimensions of 152 mm×254 mm (6 in.×10 in.) and lengths of 2744 mm (108 in.). The flexure reinforcement of the beams consisted of two #5 (16 mm) tension bars 20 and two #3 (9.5 mm) compression bars 22. To avoid shear failure, the beams were over-reinforced for shear with #3 (9.5 mm) closed stirrups 24 spaced at 102 mm (4.0 in.). Grade 60 steel having a yield strength of 415 MPa (60,000 psi) was used for all reinforcing steel. The compressive strength of the unreinforced concrete at the time the beams were tested was 55.2 MPa (8,000 psi).

Two different thickness of preferred uniaxial fabric 10 were tested. The first test sample of uniaxial fabric had a thickness of 1.0 mm (0.04 in.) and the second test sample of uniaxial fabric had a thickness of 1.5 mm (0.06 in.). The different fabric thicknesses result from the use of different yarn or fiber sizes. The matrix material 26 was a DER 332+DEH 24 hardener epoxy resin that impregnated the uniaxial fabric 10 and adhered the fabric to the appropriate surface(s) of the concrete beams. The epoxy had an ultimate strain of 4.4% to insure that the epoxy would not fail before failure of the axial fibers 14, 16, and 18.

The bottom and side surfaces of the beams were sandblasted to roughen the surfaces and then cleaned with acetone to remove any dirt. Two beams were formed with a cross-sectional shape having squared corners. The uniaxial fabric 10 was adhered only to the bottom surface of these beams as shown in FIG. 1. Two other beams (not shown) were formed with rounded corners, having 25 mm (1 in.) radius, in order to facilitate the adherence of uniaxial fabric 10 to both the bottom surface as well as extending 152 mm (6 in.) up each side surface of the beams without producing stress concentrations. For all tested beams, the uniaxial fabric 10 was extended along 2.24 m (88 in) of the length of the beams. To insure proper curing of the epoxy, the epoxy was allowed to cure for more than two weeks before testing. Testing of a control beam revealed a yield load of 82.3 kN (18.5 kips) and an ultimate load of 95.7 kN (21.5 kips). The control beam failed by the yielding of steel followed by compression failure of the concrete at the mid-span.

Figure 4:
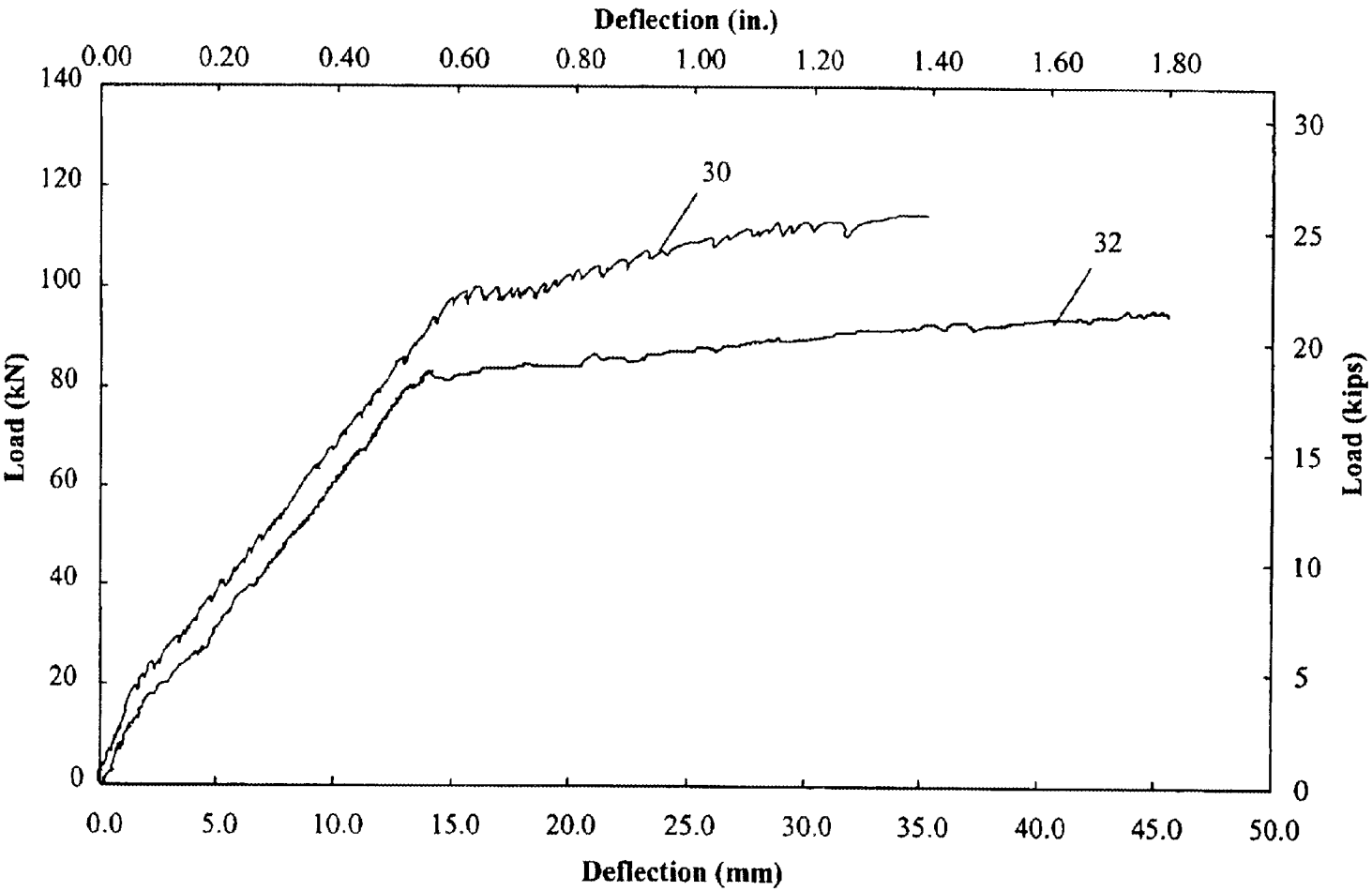
FIG. 4 is a graph illustrating the load versus mid-span deflection of a concrete beam strengthened with 1 mm thick uniaxial fabric along only the bottom surface of the beam.
Figure 5:
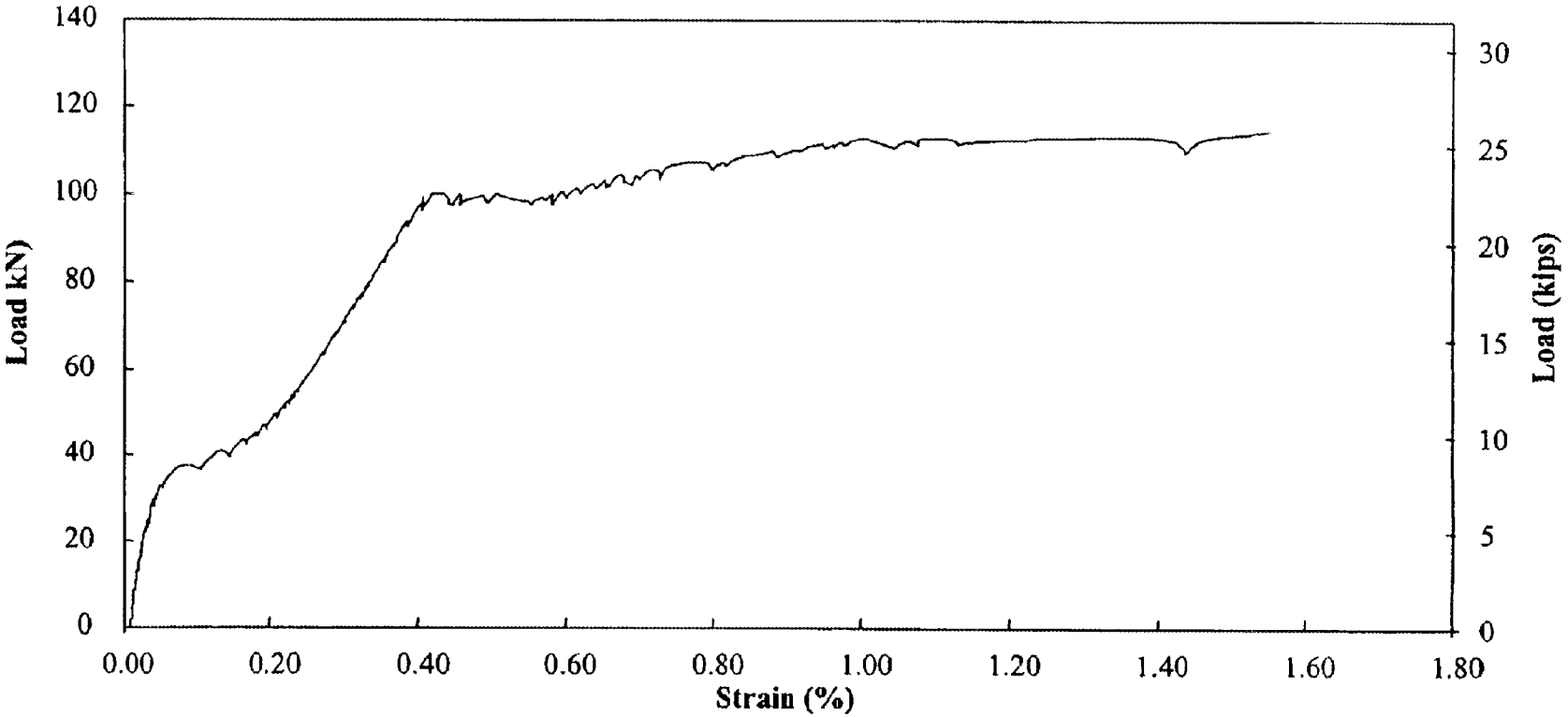
FIG. 5 is a graph illustrating the strain at mid-span of a concrete beam strengthened with 1 mm thick uniaxial fabric along only the bottom surface of the beam.

FIGS. 4–7 illustrate test results for a simple beam under two-point loading and strengthened with the uniaxial fabric 10 along only the bottom surface of the beams. FIG. 4 shows the load versus mid-span deflection response 30 for the beam strengthened with the 1 mm thick uniaxial fabric as compared to the load versus mid-span deflection response 32 for the control beam. A yield load of 97.9 kN (22.0 kips) was experienced for the fabric reinforced beam, a 19% percent increase in yield load over that of the control beam. FIG. 5 illustrates the FRP strain at mid-span showing that the uniaxial fabric 10 had approximately a strain of 0.35% indicating that the beam yielded simultaneously with the steel. The strengthened beam exhibited a considerable yielding plateau (ductility index is 2.33) up to failure by total rupture of the uniaxial fabric 10 at an ultimate load of 114.8 kN (25.8 kips).

Figure 6:
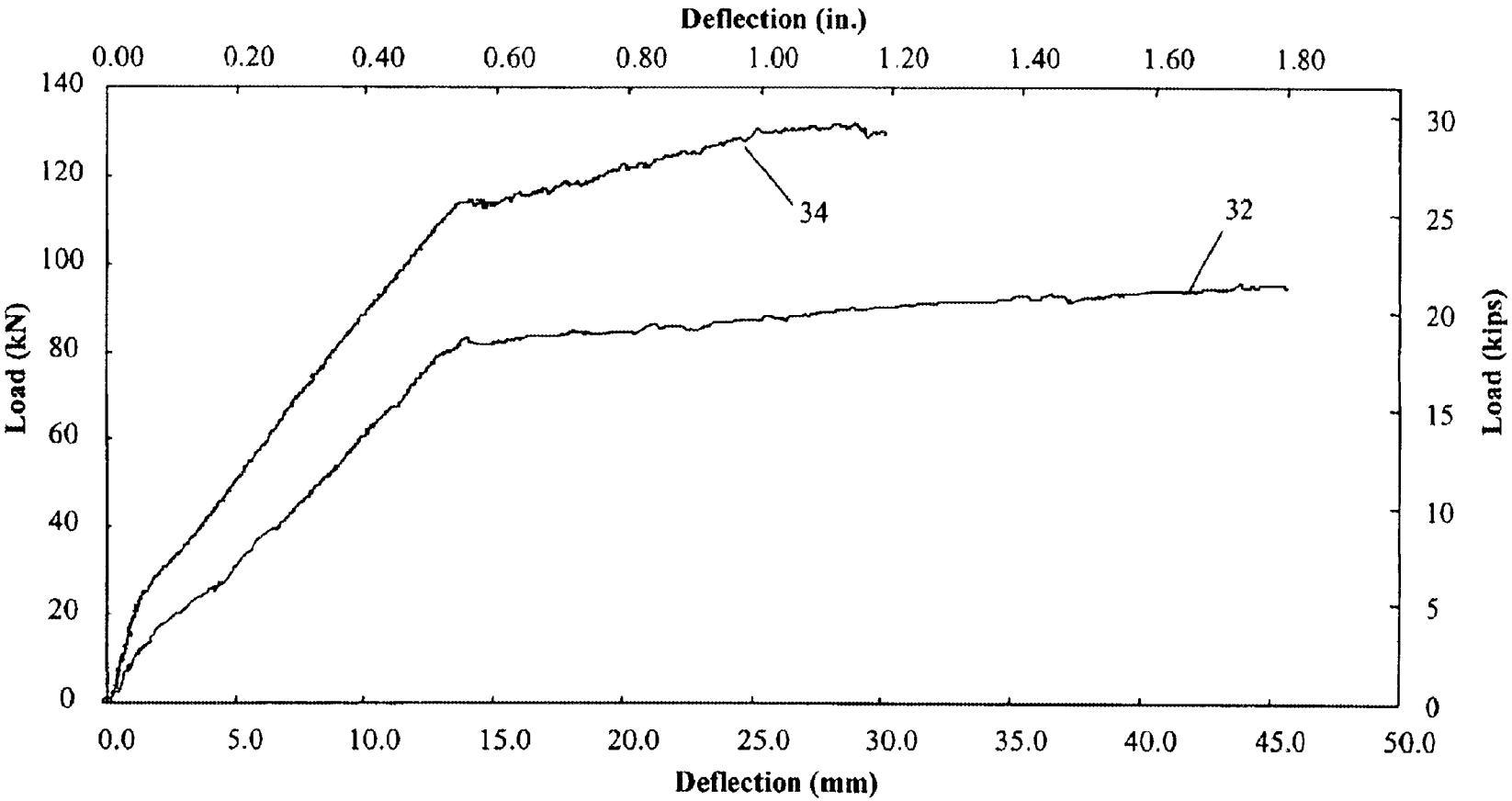
FIG. 6 is a graph illustrating the load versus mid-span deflection of a concrete beam strengthened with 1.5 mm thick uniaxial fabric along only the bottom surface of the beam.
Figure 7:
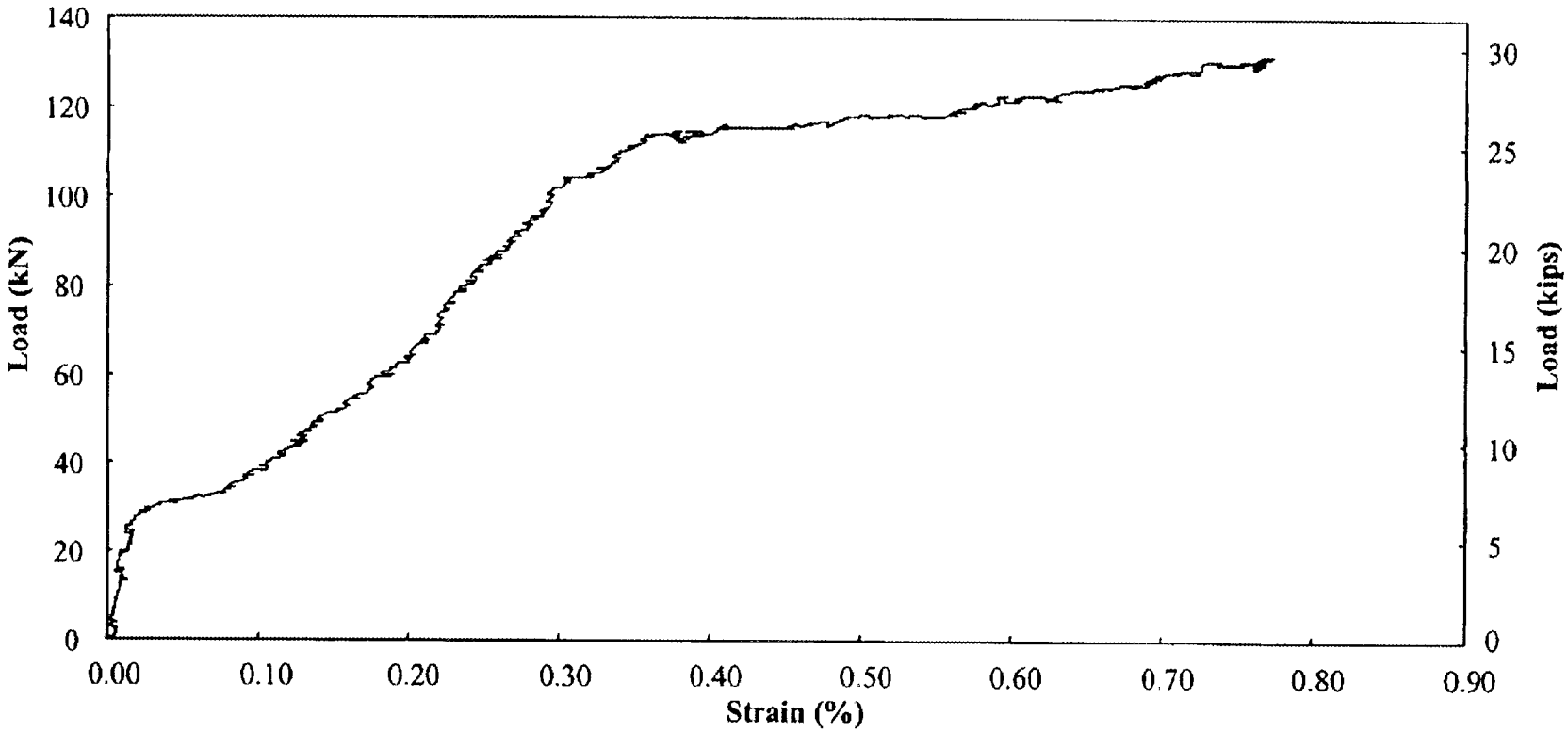
FIG. 7 is a graph illustrating the strain at mid-span of a concrete beam strengthened with 1.5 mm thick uniaxial fabric along only the bottom surface of the beam.

FIG. 6 shows the load versus mid-span deflection response 34 for the beam strengthened with 1.5 mm thick uniaxial fabric as compared to the load versus mid-span deflection response 32 for the control beam. The fabric reinforced beam yielded at a load of 113.9 kN (25.6 kips), due to the simultaneous yielding of both the steel and the uniaxial fabric 10. This beam showed a considerable yielding plateau before total failure resulting from debonding of the uniaxial fabric 10 at an ultimate load of 130.8 kN (29.4 kips). FIG. 7 illustrates the FRP strain at mid-span showing that although final failure was caused by the debonding of the uniaxial fabric 10, debonding occurred after achieving a reasonable ductility. A ductility index of 2.13 was experienced.

Figure 8:
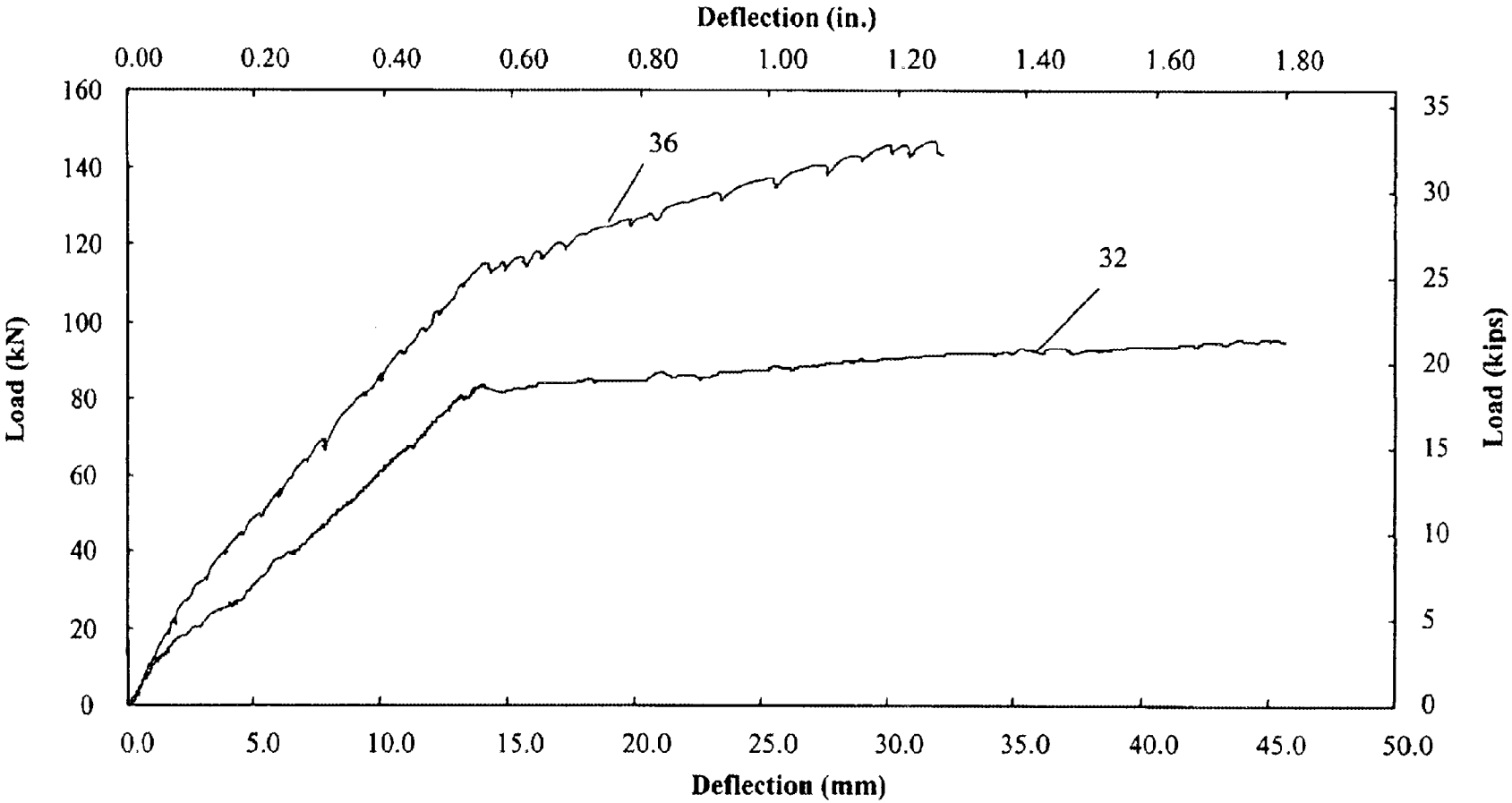
FIG. 8 is a graph illustrating the load versus mid-span deflection of a concrete beam strengthened with 1 mm thick uniaxial fabric along both the bottom surface and extending up a portion of the side surfaces of the beam.
Figure 9:
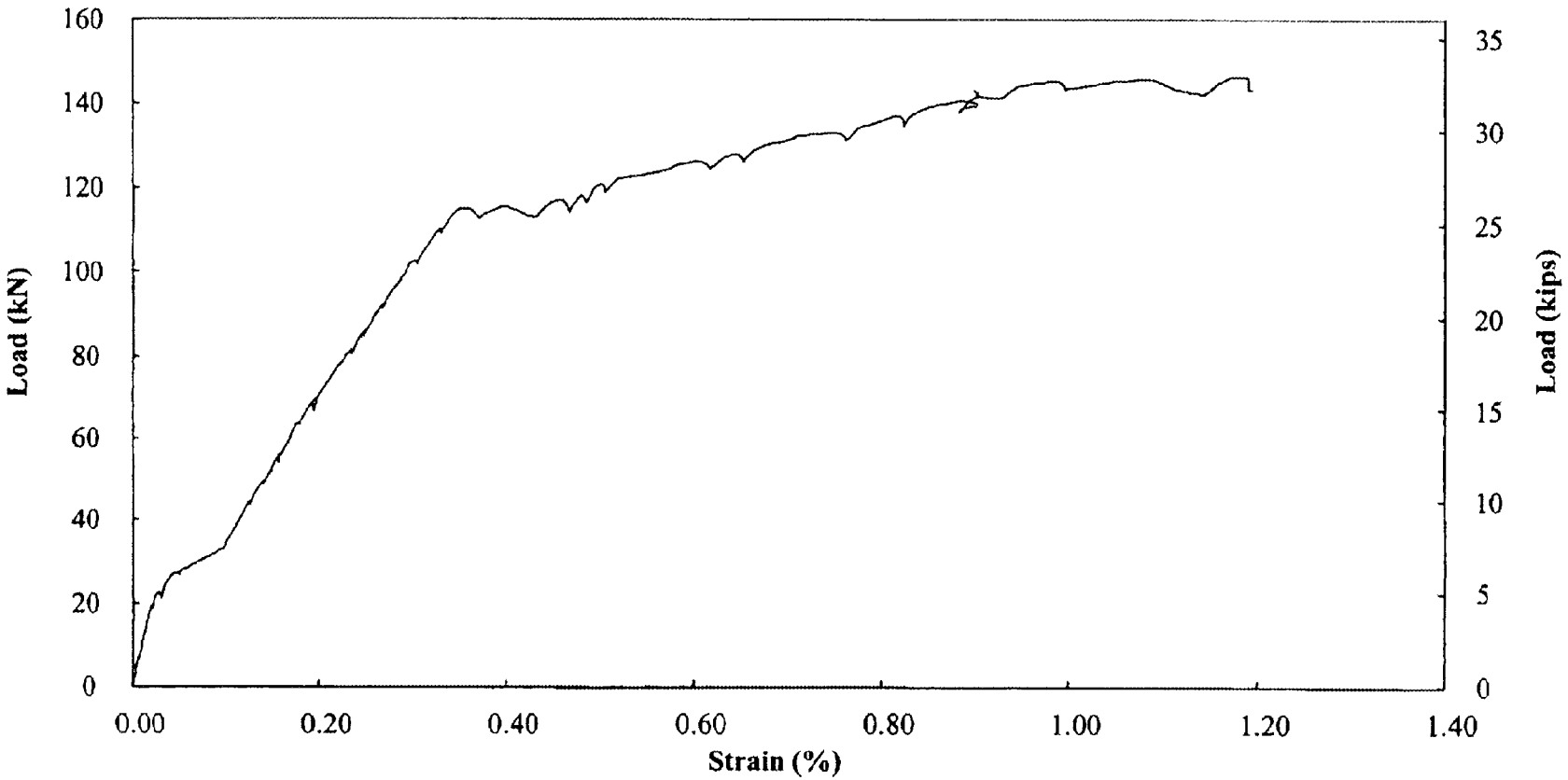
FIG. 9 is a graph illustrating the strain at mid-span of a concrete beam strengthened with 1 mm thick uniaxial fabric along both the bottom surface and extending up a portion of the side surfaces of the beam.

FIGS. 8–11 illustrate test results for control beams strengthened with uniaxial fabric 10 along both the bottom surface and extending up a portion of the side surfaces of the beams. FIG. 8 shows the load versus mid-span deflection response 36 for the beam strengthened with 1 mm thick uniaxial fabric as compared to the load versus mid-span deflection response 32 for the control beam. The strengthened beam yielded at a load of 113.9 kN (25.6 kips) due to the simultaneous yielding of both the steel and the uniaxial fabric 10. The increase in yield load gained was 38%. A yielding plateau before final failure occurred at an ultimate load of 146.4 kN (32.9 kips) due to compression failure of the concrete. A ductility index of 2.25 was experienced. FIG. 9 illustrates the FRP strain at mid-span showing the maximum recorded strain before beam failure was 1.2%.

Figure 10:
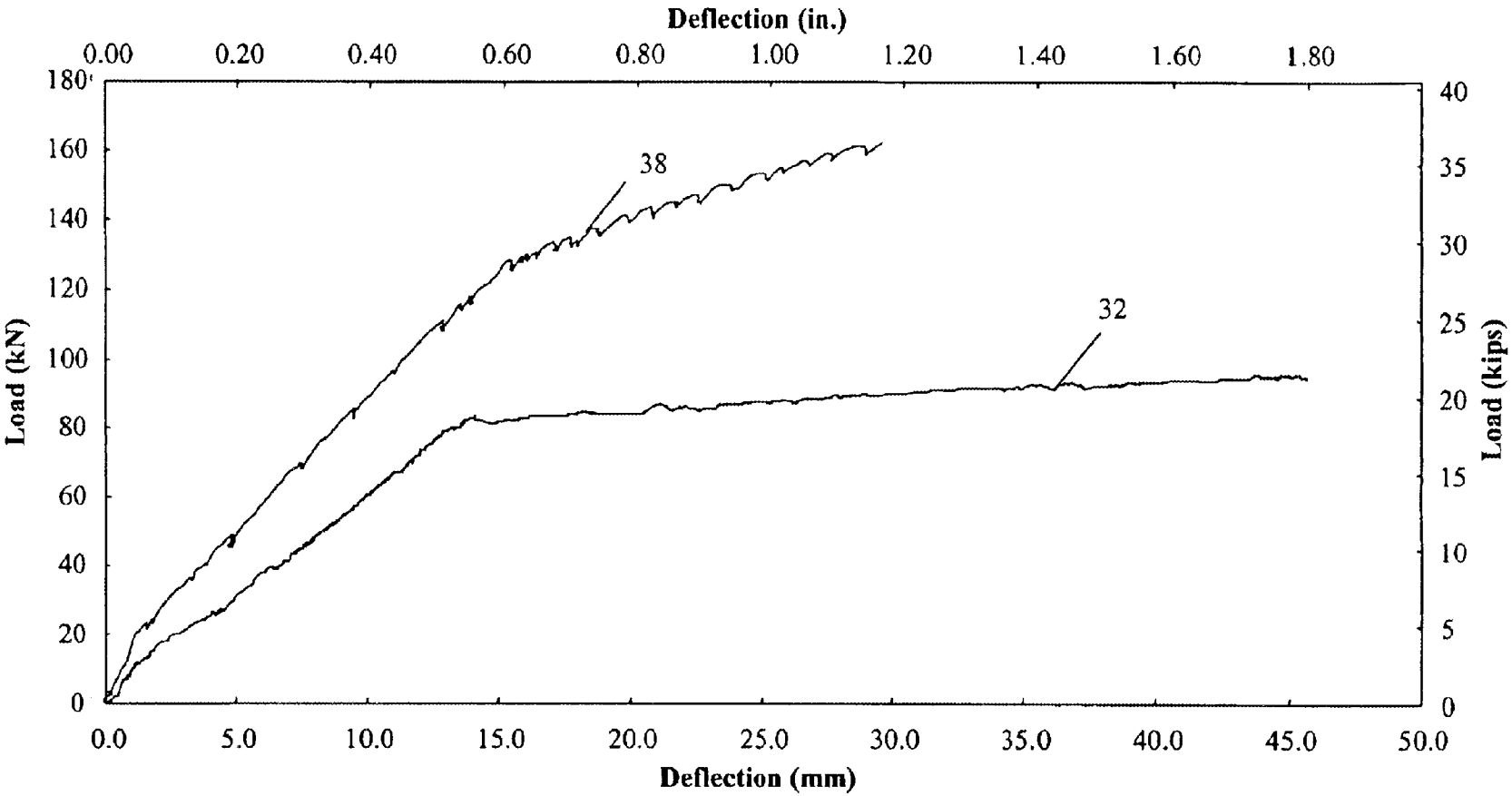
FIG. 10 is a graph illustrating the load versus mid-span deflection of a concrete beam strengthened with 1.5 mm thick uniaxial fabric along both the bottom surface and extending up a portion of the side surfaces of the beam.
Figure 11:
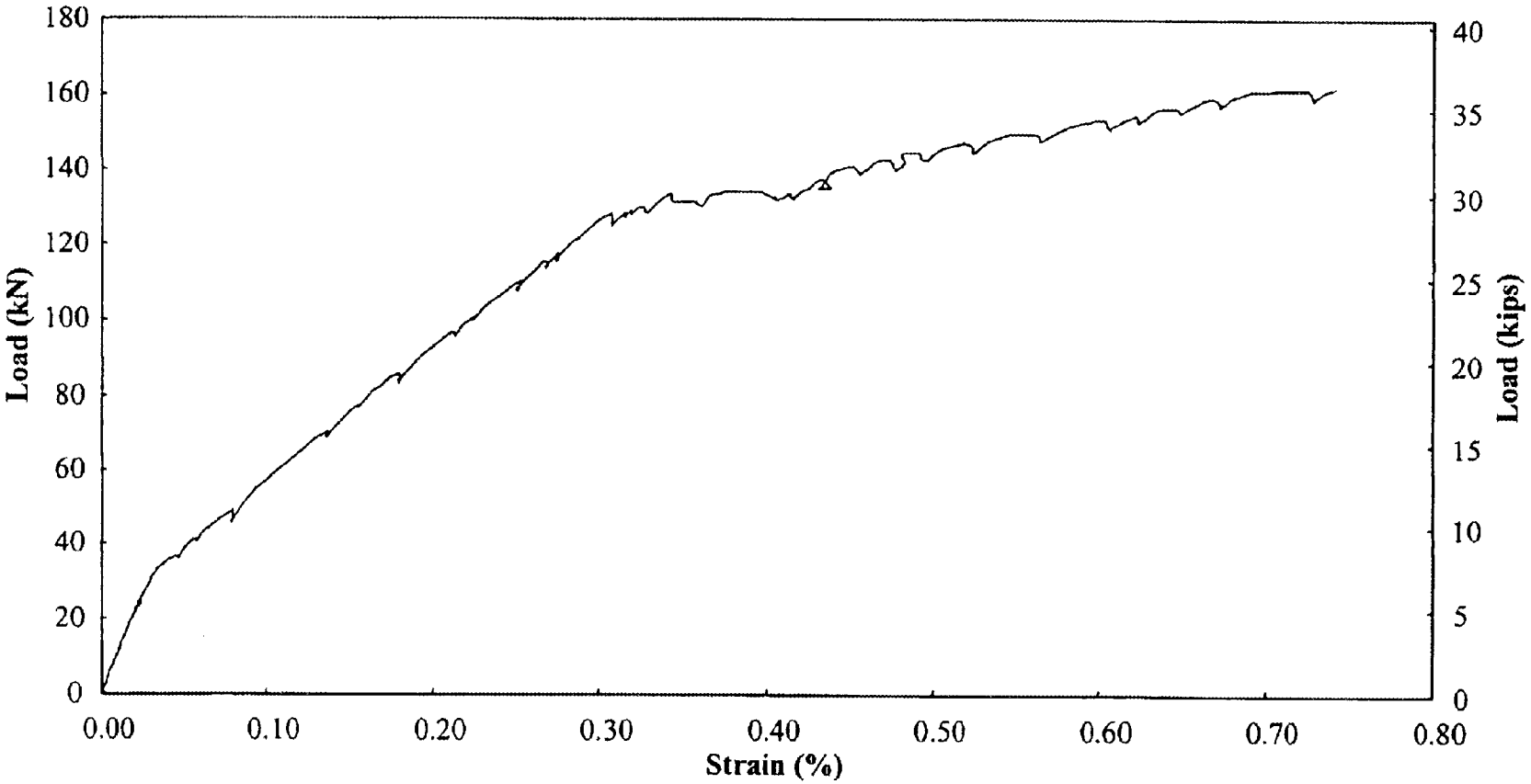
FIG. 11 is a graph illustrating the strain at mid-span of a concrete beam strengthened with 1.5 mm thick uniaxial fabric along both the bottom surface and extending up a portion of the side surfaces of the beam.

FIG. 10 shows the load versus mid-span deflection response 38 of the beam strengthened with 1.5 mm thick uniaxial fabric as compared to the load versus mid-span deflection response 32 of the control beam. FIG. 10 shows that the strengthened beam yielded at a load of 127.3 kN (28.6 kips) with an increase in yield load of 55%, due to the simultaneous yielding of both the steel and the uniaxial fabric 10. This beam finally failed at an ultimate load of 162.0 kN (36.4 kips) due to compression failure of the concrete at mid-span. This beam experienced a ductility index of 1.89. FIG. 11 illustrates the FRP strain at mid-span showing the maximum recorded strain before beam failure was 0.74%.

Figure 12:
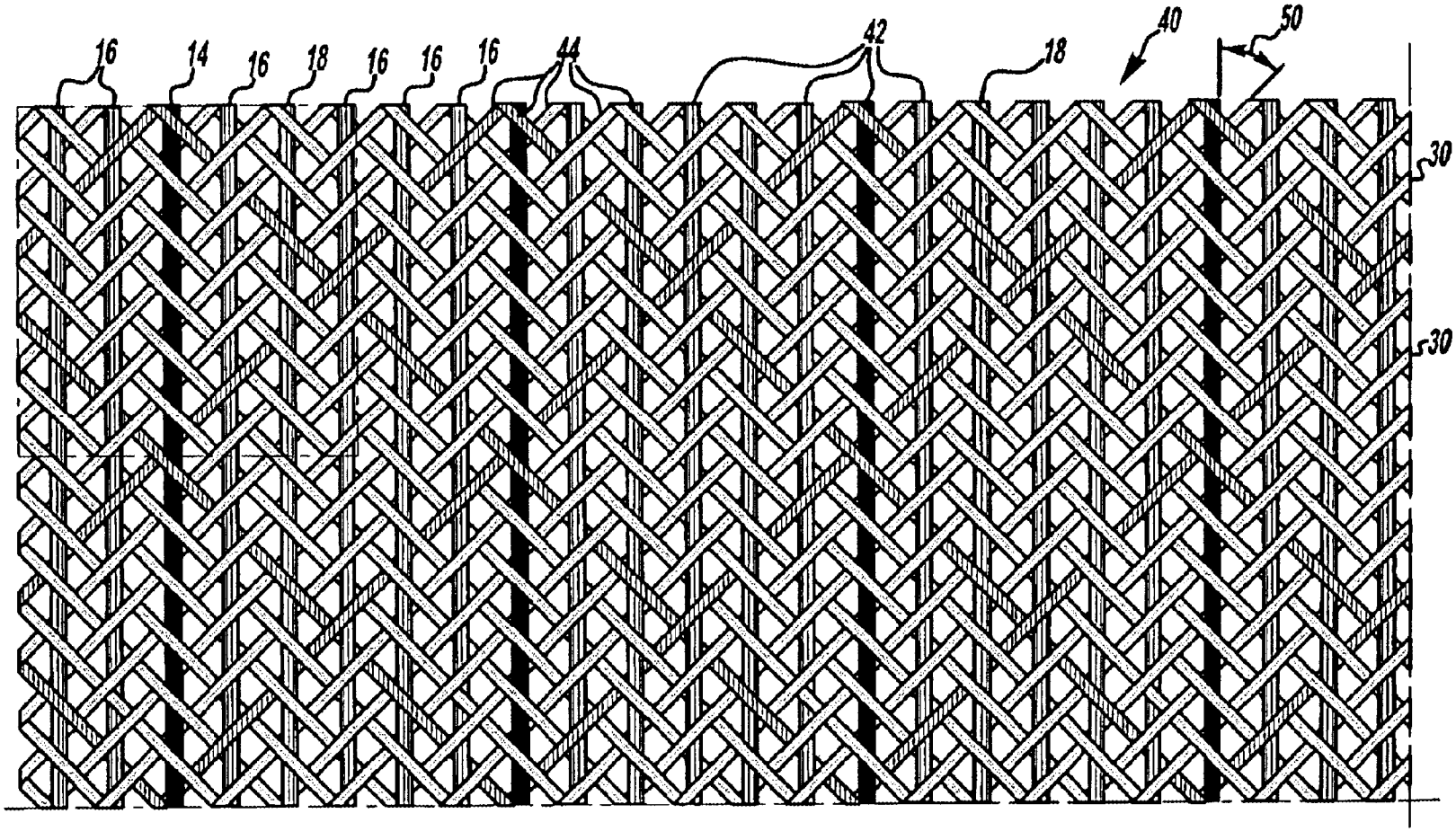
FIG. 12 is a plan view of a ductile structural fabric having a plurality of axial yarns as well as a plurality of diagonal yarns in accordance with the present invention.
Figure 13:
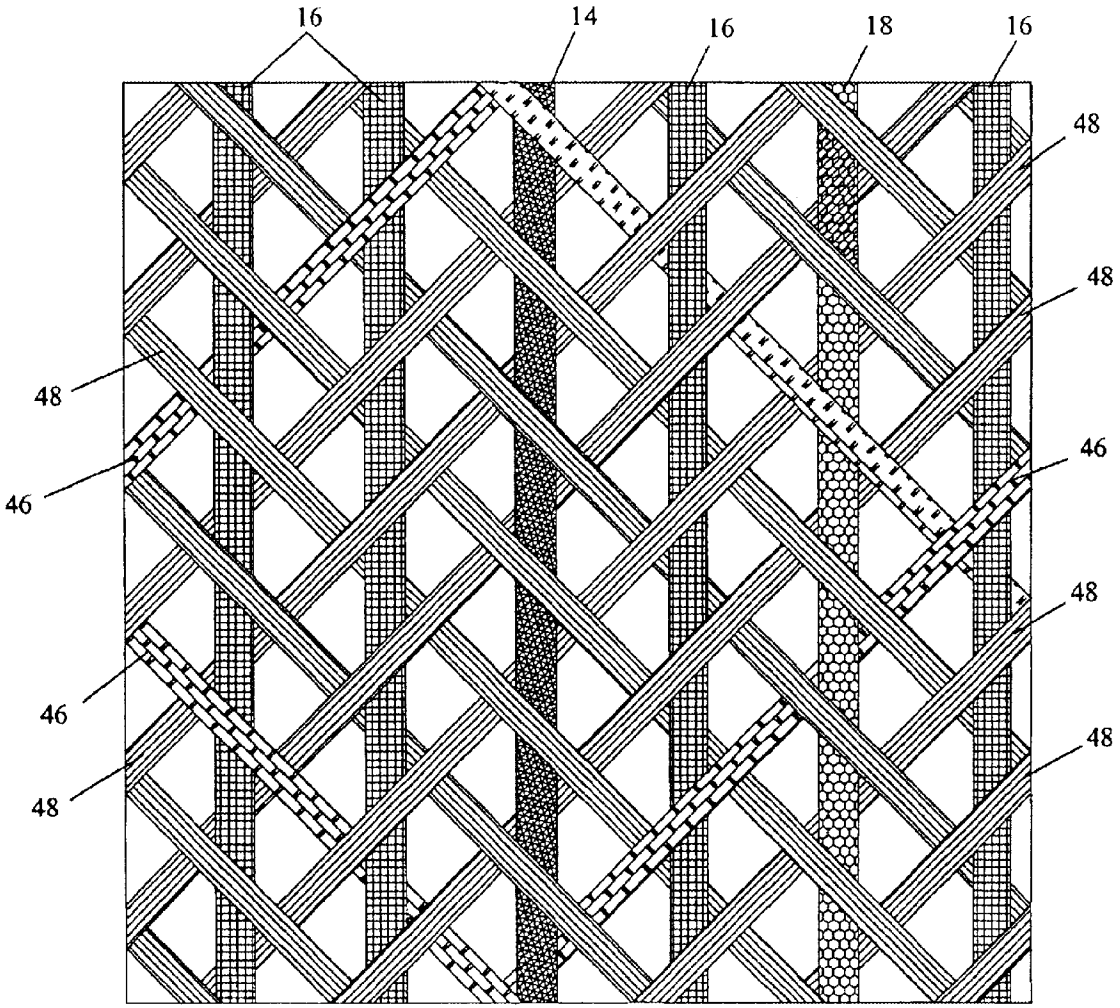
FIG. 13 is a plan view of the repeating cell of fibers in the fabric of FIG. 12 illustrating the mix of axial and diagonal fibers within the fabric.

FIG. 12 is a plan view of another embodiment of a ductile structural fabric 40 according to the present invention. The fabric 40 has a plurality of axial yarns 42 as well as a plurality of diagonal yarns 44. The diagonal yarns 44 are braided with the axial yarns 42 to provide a desired stress—strain response as the fabric 40 is loaded in tension in both the axial and diagonal directions. Just like the uniaxial fabric 10 described above, the fibers forming the axial yarns 42 include at least two, and preferably at least three, different types of fibers having different elongation characteristics. While the specific type, size, proportion, and location of the fibers may be varied for a particular application, the illustrated embodiment again includes axial yarns 42 made from low elongation fibers 14, medium elongation fibers 18, and high elongation fibers 16 (FIG. 13). The diagonal fibers 44 may also be made from a variety of materials and again preferably include at least two fibers having different elongation characteristics. In the illustrated embodiment, the diagonal fibers are made from medium elongation fibers 46 and high elongation fibers 48 which may be the same as, or different from, the medium and high elongation fibers 18 and 16 used in the axial direction. The elongation ratio between axial fibers 14, 16 and 18 and between the diagonal fibers 46 and 48 within the fabric 40 are again selected to provide high stiffness before yield as well as ductility.

As noted above and illustrated in FIGS. 12 and 13, the triaxial fabric 40 is braided with the axial fibers 42 being aligned in a single plane and the diagonal fibers 44 woven in an undulated fashion above and below adjacent axial fibers. The diagonal yarns 44 form a braid angle 50 (FIG. 12) that is preferably, though not necessarily, equal to forty-five degrees. A forty-five degree braid angle has the benefit of orienting the diagonal yarns substantially perpendicular to the potential shear cracks thereby enhancing the strengthening by resisting the diagonal tension due to shear. Thus, the fabric provides beam shear strengthening in addition to the flexural strengthening when the fabric is installed on the beam sides. A variety of braiding or weaving techniques may be used to manufacture the triaxial fabric 40. However, a 2×2 triaxial braiding technique has been found to be particularly suitable for braiding the fibers contemplated for the present invention.

FIG. 13 is a plan view of a portion of the triaxial fabric 40 of FIG. 12 illustrating the mix of the axial fibers 42 and the diagonal fibers 44 within the repeating cells of the triaxial fabric 40. When the triaxial fabric 40 is loaded in tension in the axial or zero degree direction, the low elongation fibers 14 fail first allowing a strain relaxation just as in the uniaxial fabric 10 described above. As a result, an increase in strain takes place without an increase in load. This yielding phenomena provides a ductile behavior not previously available in the art. The remaining medium elongation fibers 18, high elongation fibers 16, and the diagonal yarns 44 are selected and proportioned to incrementally sustain the total load after failure of the low elongation fibers 14 in the same manner as in the uniaxial fabric 10. Thus, after a predetermined increase in strain, the medium elongation fibers 18 fail allowing a second strain relaxation. The amount of high elongation fibers 16 and the diagonal yarns 46 and 48 are chosen to sustain the total load up to failure. The first and second strain relaxations provide considerable fabric ductility.

When the triaxial fabric 40 is diagonally loaded, such as at either the plus or minus forty-five degree directions, the ductile behavior is achieved in a slightly different manner. When the actual strain reaches the ultimate strain of the diagonal medium elongation fibers 48 the fibers fail thereby allowing a strain relaxation. The remaining diagonal high elongation fibers 46 as well as the axial yarns are selected and proportioned to sustain the total load up to design failure. The maximum strain values for each fiber are properly selected to fit with ductility mechanisms as well as the stiffness requirements.

In selecting the diagonal medium elongation fibers 46, consideration of the undulation of the diagonal fibers should be made. The undulating fibers can not sustain the same strain magnitudes as when the fibers are disposed in a straight and planar manner as in the axial direction. Therefore, the medium elongation diagonal fibers 46 are selected so that the maximum strain of the undulated medium elongation diagonal fibers 46 is more than the yield strain of steel (about 0.2% for Grade 60 steel) and slightly less than the expected maximum strain before debonding of the strengthening material from the concrete surface usually experienced by shear strengthening cases (the effective strain). The high elongation diagonal fibers 48 are selected so that the undulated high elongation diagonal fibers 48 can sustain the load along with the axial yarns up to the total failure of the fabric.

Similar to the uniaxial fabric 10, the triaxial fabric 40 is completed by combining the axial and diagonal fibers in accordance with the fabric mix and impregnating the mix inside a mold with a high strength matrix such as epoxy or high strength cement slurry. The triaxial fabric 40 was tested on a reinforced concrete beam having the same cross sectional dimensions and reinforcement as the test beams for the uniaxial fabric.

The test sample of the triaxial fabric 40 had a thickness of 3.5 mm (0.14 in.). The tested triaxial fabric 40 included repeating cells of one low elongation axial fiber 14 made from 24 k of Dialead® K63712, one medium elongation axial fiber 18 made from 108 k of Torayca®, four high elongation axial fibers 16 made from 68.9 yd/lb of Hybon® 2022 glass, two medium elongation diagonal fibers 46 made from 108 k of Torayca® M46 carbon fibers, and ten high elongation diagonal fibers 48 made from 118.1 yd/lb of Hybon® 2022 glass fibers. The spacing between axial fibers 14, 16 and 18 was 0.25 inches and the spacing between the diagonal fibers was 0.1768 inches. The same epoxy resin used in the uniaxial test fabric was impregnated into the triaxial fabric 40 and used to adhere the triaxial fabric 40 to the appropriate surface(s) of the concrete beams. The epoxy again had an ultimate strain of 4.4% to insure that the epoxy would not fail before failure of the high elongation axial and diagonal fibers.

Figure 14:
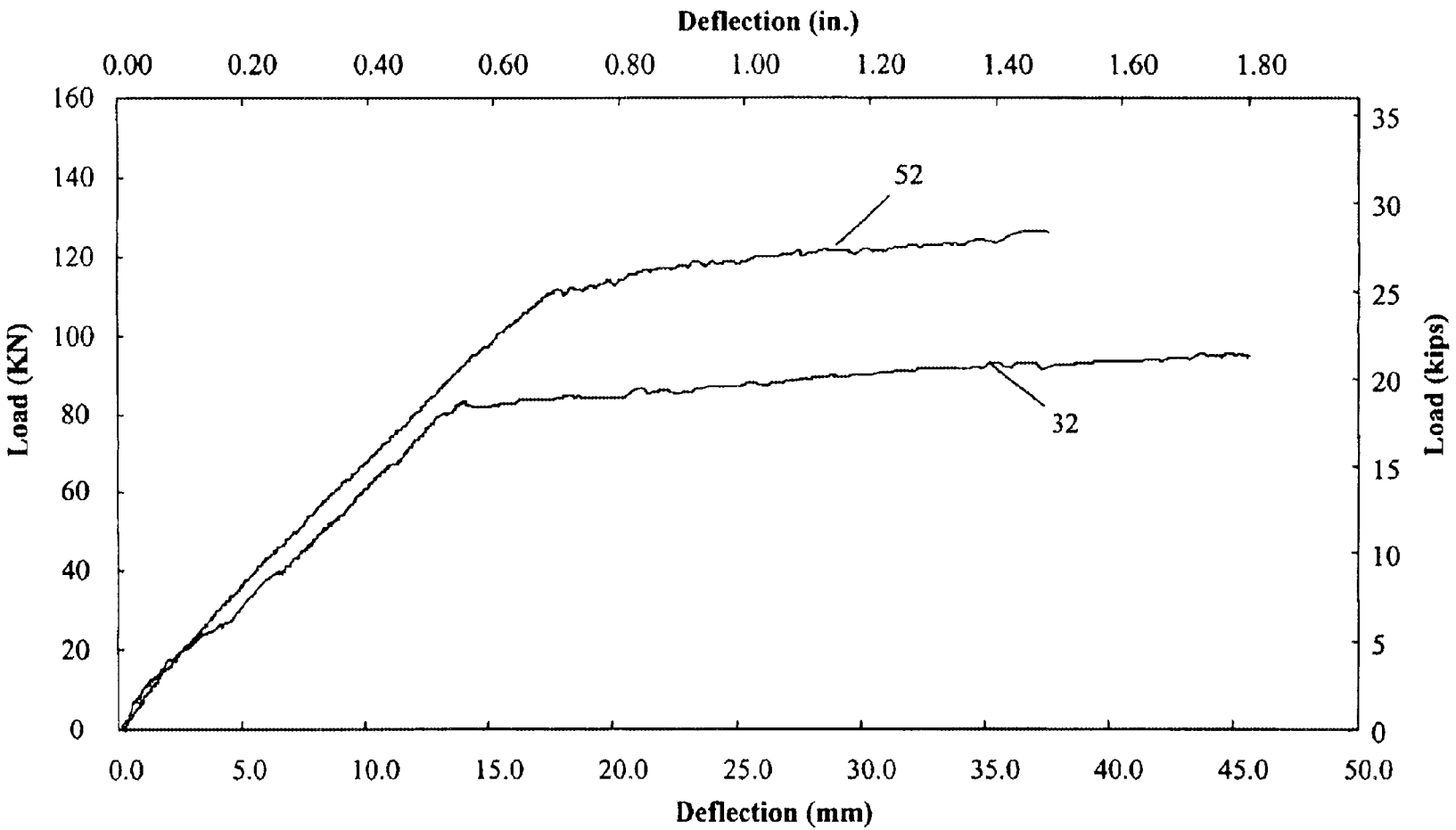
FIG. 14 is a graph illustrating the load versus mid-span deflection of a concrete beam strengthened with a 3.5 mm thick triaxial fabric along only the bottom surface of the beam.
Figure 15:
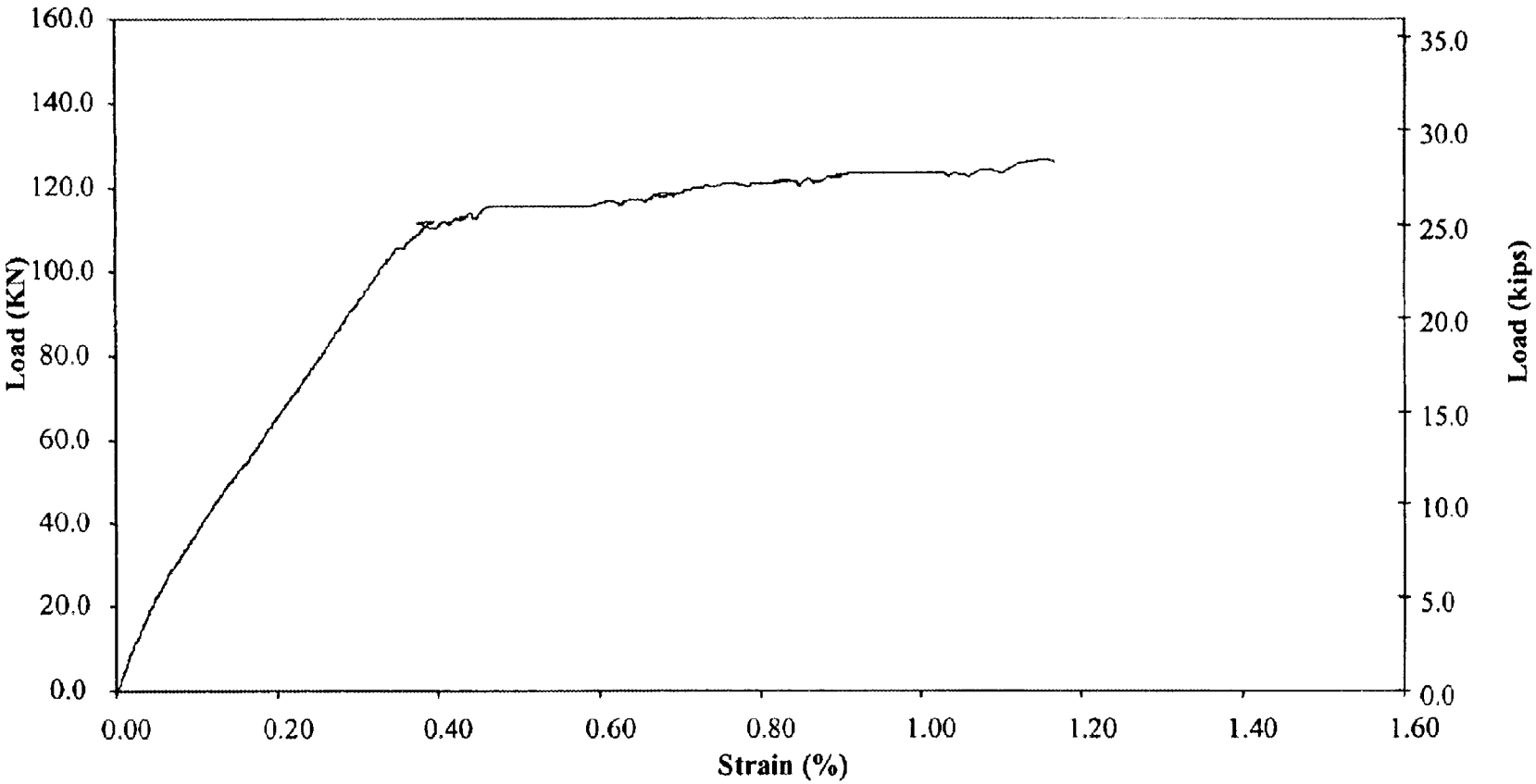
FIG. 15 is a graph illustrating the strain at mid-span of a concrete beam strengthened with a 3.5 mm thick triaxial fabric along only the bottom surface of the beam.

FIGS. 14 and 15 illustrate simple beam two-point load test results for the beam strengthened with the above-described triaxial fabric 40 along only the bottom surface of the beams. FIG. 14 shows the load versus mid-span deflection response 52 for the fabric strengthened beam as compared to the load versus mid-span deflection response 32 for the control beam 8. A yield load of 111.3 kN (25.0 kips) was experienced which is a 35% percent increase in yield load over that of the control beam. FIG. 15 illustrates the test beam strain at mid-span showing that the triaxial fabric 40 had strain of approximately 0.35% when the beam which indicates that it yielded simultaneously with the steel reinforcement. This beam experienced a considerable yielding plateau similar to the non-strengthened beam, a ductility index of 2.11, and failed by total rupture of the triaxial fabric 10' at an ultimate load of 126.4 kN (28.4 kips).

Based on the above description, those skilled in the art will appreciate that the ductile structural fabric of the present invention provides significant benefits for strengthening steel-reinforced concrete beams. However, the significant benefits of the invention are not limited to such applications. The fabric, and particularly the triaxial fabric 40, is suitable for a wide array of uses beyond strengthening structural components such as steel reinforced concrete. For example, the fabric may be used to strengthen other structural components such as steel beams. Further, the high strength, ductile, and lightweight properties of the fabric may be capitalized upon to increase a structure's resistance to attack such as from impact forces. As to impact forces, the yielding of the fabric assists in dissipating energy from impact before failure takes place. Various manufacturing techniques generally known in the art may be used to develop various solid shapes and configurations using the fabric of the present invention to create vehicle or aircraft components such as body panels, tracks, and wheels. These components will be generally stronger and lighter in weight than currently available components.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A structural fabric for use in strengthening a concrete structure having reinforcement with a yield strain, said structural fabric comprising:

a first fiber having a first ultimate strain;

a second fiber having a second ultimate strain greater than said first ultimate strain, said second fiber being in the same plane as said first fiber; and wherein said first ultimate strain is between 0.2% an about 0.35% and selected so that when the fabric is fixed to the concrete structure the fabric yields with the reinforcement.

2. The structural fabric of claim 1 wherein the fabric has a yield strain equal to the ultimate strain of the first fiber and wherein the fabric has an ultimate strain equal to the ultimate strain of the second fiber.

3. The structural fabric of claim 1 further including a matrix material surrounding the first and second fibers and wherein the matrix material is a concrete slurry.

4. The structural fabric of claim 1 wherein the fabric further includes a third fiber having a third ultimate strain greater than said first ultimate strain and less than said second ultimate strain, said third fiber being in the same plane as said first fiber.

5. The structural fabric of claim 4 wherein said first, second, and third fibers are parallel to one another.

6. The structural fabric of claim 1 wherein the first and second fibers define axial yarns, wherein the fabric further includes a first plurality of diagonal yarns including a first diagonal fiber having a first ultimate strain and a second diagonal fiber having a second ultimate strain greater than said first ultimate strain, and wherein the first and second diagonal fibers are positioned at an angle relative to the axial yarns.

7. The structural fabric of claim 6 further including a second plurality of diagonal yarns oriented at a second angle relative to the axial yarns and wherein said second plurality of diagonal yarns also include a first fiber having a first ultimate strain and a second fiber having a second ultimate strain greater than said first ultimate strain.

8. The structural fabric of claim 6 wherein the first angle is plus forty-five degrees and the second angle is minus forty-five degrees.

9. The structural fabric of claim 7 wherein the plurality of axial yarns are disposed in a common plane and the first and second plurality of diagonal yarns are braided with respect the plurality of axial yarns in an undulating pattern.

10. The structural fabric of claim 1 wherein said second ultimate strain is at least about 2.0%.

11. The structural fabric of claim 4 wherein the third ultimate strain is at least about 0.8% and no more than about 1.0%.

12. A strengthened reinforced concrete structure comprising:

a concrete member having embedded reinforcement and an outer surface, said reinforcement having a yield strain; and a structural fabric fixed to said outer surface, said structural fabric including a first fiber having a first ultimate strain and a second fiber having a second ultimate strain greater than said first ultimate strain, said second fiber being in the same plane as and parallel to said first fiber, wherein said first ultimate strain defines a fabric yield strain, and wherein said first fiber is selected so that said fabric yields with said reinforcement.

13. The strengthened reinforced concrete structure of claim 12 wherein said structural fabric is spaced from said reinforcement and subjected to greater tensile strain than said reinforcement and wherein said first fiber is selected such that said first fiber is subjected to said first ultimate strain when said reinforcement is subjected to said reinforcement yield strain.

14. The strengthened reinforced concrete structure of claim 13 wherein said reinforcement has a yield strain of about 0.2% and said first ultimate strain is between 0.2% and about 0.35%.

15. The strengthened reinforced concrete structure of claim 14 wherein said second ultimate strain is at least about 2.0%.

16. The strengthened reinforced concrete structure of claim 12 wherein said concrete member is a concrete beam, wherein said outer surface includes a bottom and a side, and wherein said structural fabric is fixed to at least said bottom.

17. The strengthened reinforced concrete structure of claim 12 wherein the fabric includes a third fiber having a third ultimate strain greater than said first ultimate strain and less than said second ultimate strain, said third fiber being in the same plane as said first fiber.

18. The strengthened reinforced concrete structure of claim 17 wherein said reinforcement has a yield strain of about 0.2% and said first ultimate strain is between 0.2% and about 0.35%, wherein said second ultimate strain is at least about 2.0%, and wherein the third ultimate strain is at least about 0.8% and no more than about 1.0%.

19. The strengthened reinforced concrete structure of claim 12 wherein said fabric further includes a matrix, wherein said first and second fibers are embedded in said matrix, and wherein said matrix is fixed to said outer surface.

20. The strengthened reinforced concrete structure of claim 19 wherein said matrix is an epoxy resin and said matrix is fixed to said outer surface.

21. The strengthened reinforced concrete structure of claim 19 wherein said matrix is a concrete slurry.

22. The strengthened reinforced concrete structure of claim 12 wherein the first and second fibers define axial yarns and wherein the fabric further includes a first plurality of diagonal yarns having a first diagonal fiber with an ultimate strain and a second diagonal fiber with an ultimate strain greater than the ultimate strain of the first diagonal fiber.

23. The strengthened reinforced concrete structure of claim 22 wherein the first and second diagonal fibers are positioned at a first angle relative to the axial yarns.

24. The strengthened reinforced concrete structure of claim 23 further including a second plurality of diagonal yarns oriented at a second angle relative to the axial yarns and wherein the second plurality of diagonal yarns also include a first fiber having an ultimate strain and a second fiber having an ultimate strain greater than the ultimate strain of the first fiber.

25. The strengthened reinforced concrete structure of claim 23 wherein the first angle is plus forty-five degrees and the second angle is minus forty-five degrees.

26. The strengthened reinforced concrete structure of claim 24 where the plurality of axial yarns are disposed in a common plane and the first and second plurality of diagonal yarns are braided with respect the plurality of axial yarns in an undulating pattern.

27. The strengthened reinforced concrete structure of claim 22 wherein said outer surface includes a tension surface and a shear surface and wherein said structure fabric is fixed to said tension surface and said shear surface.

28. The strengthened reinforced concrete structure of claim 27 wherein first and second plurality of diagonal yarns are oriented substantially perpendicular to expected shear cracks on said shear surface.

29. The strengthened reinforced concrete structure of claim 28 wherein said concrete member is a concrete beam and wherein said concrete beam includes a bottom surface defining said tension surface and a side surface defining said shear surface.

30. A strengthened reinforced concrete structure comprising:

a concrete member having embedded reinforcement and an outer surface, said reinforcement having a yield strain; and a structural fabric fixed to said outer surface, said structural fabric including a first fiber having a first ultimate strain and a second fiber having a second ultimate strain greater than said first ultimate strain, wherein said first ultimate strain defines a fabric yield strain and is between 0.2% and about 0.35%.

31. The strengthened reinforced concrete structure of claim 30 wherein the fabric includes a third fiber having a third ultimate strain greater than said first ultimate strain and less than said second ultimate strain, wherein said second ultimate strain is at least about 2.0%, and wherein the third ultimate strain is at least about 0.8% and no more than about 1.0%.

* * * * *